US006962560B2

(12) United States Patent
Grewal

(10) Patent No.: US 6,962,560 B2
(45) Date of Patent: Nov. 8, 2005

(54) CONTINUOUS CENTRIFUGAL SEPARATION OF SLURRY USING BALLS CONTAINED IN A RECESS OF A BOWL

(75) Inventor: Ishwinder Singh Grewal, Surrey (CA)

(73) Assignee: Knelson Patents Inc., Langley (CA)

( * ) Notice: Subject to any disclaimer, the term of this patent is extended or adjusted under 35 U.S.C. 154(b) by 146 days.

(21) Appl. No.: 10/630,920

(22) Filed: Jul. 31, 2003

(65) Prior Publication Data

US 2005/0026766 A1 Feb. 3, 2005

(51) Int. Cl.[7] ..... B04B 11/04

(52) U.S. Cl. ..... 494/29; 494/37; 494/56; 494/80; 494/36

(58) Field of Search ..... 494/1, 5, 11, 23, 494/27–30, 37, 56, 63, 80, 36; 210/360.1, 380.1; 209/453, 485

(56) References Cited

U.S. PATENT DOCUMENTS

| | | | | | |
|---|---|---|---|---|---|
| 459,197 | A | * | 9/1891 | Bodge | 210/365 |
| 459,858 | A | * | 9/1891 | Seymour | 494/47 |
| 489,101 | A | * | 1/1893 | Seymour | 209/199 |
| 556,567 | A | * | 3/1896 | Waring | 494/80 |
| 726,948 | A | * | 5/1903 | Land | 494/67 |
| 917,123 | A | * | 4/1909 | Peck | 494/29 |
| 957,478 | A | * | 5/1910 | Simpson | 494/30 |
| 980,001 | A | * | 12/1910 | Ponten | 494/35 |
| 981,679 | A | * | 1/1911 | Peck | 494/11 |
| 1,011,078 | A | * | 12/1911 | Peck | 494/11 |
| 1,012,097 | A | * | 12/1911 | Peck | 494/1 |
| 1,283,846 | A | * | 11/1918 | Mark et al. | 494/60 |
| 1,322,139 | A | * | 11/1919 | Schifferle | 494/28 |
| 1,473,421 | A | * | 11/1923 | Eccleston | 494/29 |
| 1,557,672 | A | * | 10/1925 | Doerner | 209/199 |
| 1,594,501 | A | * | 8/1926 | Eccleston | 494/29 |
| 1,599,502 | A | * | 9/1926 | Thomassen | 494/43 |

(Continued)

FOREIGN PATENT DOCUMENTS

| | | | |
|---|---|---|---|
| AU | 17487 | | 6/1935 |
| AU | 22055 | | 4/1936 |
| CA | 2085064 | * | 6/1993 |
| CA | 2436496 | * | 12/2003 |
| DE | 1632324 | | 10/1970 |
| DE | 2031350 | * | 12/1971 |
| GB | 2133722 | | 8/1984 |
| JP | 58-24366 | * | 2/1983 |
| JP | 11-276110 | * | 10/1999 |

*Primary Examiner*—Charles E. Cooley
(74) *Attorney, Agent, or Firm*—Adrian D. Battison; Michael S. Williams; Ryan W. Dupuis

(57) ABSTRACT

A centrifuge bowl for separating heavier particles from lighter particles and water comprises a first conical bowl wall leading to a pair of annular recesses at actually spaced positions. Each recess is generally V-shaped with an upper side wall, a lower side wall and a base. The base contains a plurality of angularly spaced discharge ducts each having a pinch valve by which it can be closed and mouth projecting through the base into the interior of the bowl for collecting the heavier particles. Each recess includes injection openings in the upper and lower side walls of the recess arranged to inject fluidizing water in a direction generally parallel to the base and across the mouth of each discharge duct. An insert member formed by two annular screens can be inserted into the recess radially inwardly of the discharge and injection holes and contains a bed of beads which act to float inwardly while the valves are closed and to collapse outwardly when the valves are opened.

27 Claims, 3 Drawing Sheets

U.S. PATENT DOCUMENTS 1,684,870 A * 9/1928 Lewis ..... 209/199
1,718,547 A * 6/1929 Eccleston ..... 494/29
1,750,860 A * 3/1930 Rawlings ..... 494/2
1,853,249 A * 4/1932 Ainlay ..... 494/43
1,882,389 A * 10/1932 Wesley ..... 494/11
1,935,547 A * 11/1933 Dryhurst ..... 494/67
1,988,500 A * 1/1935 Lack ..... 209/199
2,022,926 A * 12/1935 Schlank ..... 494/32
2,112,099 A * 3/1938 McK Ballou et al. ..... 494/67
2,132,195 A * 10/1938 Stirn ..... 494/80
2,161,476 A * 6/1939 Leja ..... 494/45
2,161,477 A * 6/1939 Leja ..... 209/422
2,179,807 A * 11/1939 Asmussen ..... 494/27
2,230,013 A * 1/1941 Pecker ..... 494/58
2,272,675 A * 2/1942 Knudsen ..... 494/45
2,472,475 A * 6/1949 Hamilton ..... 209/199
2,782,925 A * 2/1957 Morton ..... 494/27
3,152,074 A * 10/1964 Fontein et al. ..... 210/781
3,256,993 A * 6/1966 Werner et al. ..... 210/370
3,366,318 A * 1/1968 Carl ..... 494/7
3,823,869 A 7/1974 Loison
3,963,175 A * 6/1976 Daubman et al. ..... 494/74
4,279,741 A * 7/1981 Campbell ..... 209/44
4,286,748 A * 9/1981 Bailey ..... 494/29
4,361,480 A * 11/1982 Corbus et al. ..... 209/453
4,533,344 A * 8/1985 Gunnewig ..... 494/36
4,608,040 A * 8/1986 Knelson ..... 494/27
4,776,833 A * 10/1988 Knelson ..... 494/27
4,846,781 A * 7/1989 Knelson ..... 494/27
4,981,219 A * 1/1991 Burnell et al. ..... 209/453
4,983,156 A * 1/1991 Knelson ..... 494/28
5,087,127 A * 2/1992 Knelson ..... 494/37
5,222,933 A * 6/1993 Knelson et al. ..... 494/29
5,230,797 A * 7/1993 Knelson ..... 210/380.1
5,338,284 A * 8/1994 Knelson ..... 494/28
5,354,256 A * 10/1994 Knelson ..... 494/80
5,368,541 A * 11/1994 Knelson ..... 494/37
5,372,571 A * 12/1994 Knelson et al. ..... 494/29
5,421,806 A * 6/1995 Knelson et al. ..... 494/37
5,462,513 A * 10/1995 McAlister ..... 494/56
5,586,965 A * 12/1996 Knelson ..... 494/29
5,601,523 A * 2/1997 Knelson ..... 494/29
5,601,524 A * 2/1997 Knelson ..... 494/29
5,713,826 A * 2/1998 West ..... 494/45
5,728,039 A * 3/1998 Knelson ..... 494/29
5,895,345 A * 4/1999 Knelson ..... 494/29
6,095,965 A * 8/2000 Eiderman et al. ..... 494/80
6,149,572 A * 11/2000 Knelson ..... 494/37
6,796,934 B1 * 9/2004 McAlister et al. ..... 494/56
6,869,389 B2 * 3/2005 Mackel et al. ..... 494/36
2004/0121892 A1 * 6/2004 Zonneveld et al. ..... 494/67
2004/0132601 A1 * 7/2004 Peacocke et al. ..... 494/29
2005/0026766 A1 * 2/2005 Grewal ..... 494/29

* cited by examiner

CONTINUOUS CENTRIFUGAL SEPARATION OF SLURRY USING BALLS CONTAINED IN A RECESS OF A BOWL

The invention relates to the continuous centrifugal separation of heavier particulate materials from light in particulate materials in a slurry of the materials, in which the slurry is passed over the peripheral wall of the centrifuge bowl for collection of the heavier materials on the wall of the bowl with a plurality of discharge openings at angularly spaced positions around the wall to allow the heavier materials to discharge from the bowl while the slurry runs continuously through the bowl.

BACKGROUND OF THE INVENTION

The present inventor has the following patents which disclose machines of this general type and features which relate to such machines:

| | |
|---|---|
| U.S. Pat. No. 5,222,933 | Issued Dec. 13, 1994 |
| U.S. Pat. No. 5,338,284 | Issued Aug. 16, 1994 |
| U.S. Pat. No. 5,586,965 | Issued Dec. 24, 1996 |
| U.S. Pat. No. 5,601,523 | Issued Feb. 11, 1997 |
| U.S. Pat. No. 5,601,524 | Issued Feb. 11, 1997 |
| U.S. Pat. No. 4,608,040 | Issued Aug. 26, 1986 |
| U.S. Pat. No. 6,149,572 | Published Nov. 21, 2000 |

In addition to the above patents of the present inventor, the following patents by other inventors show machines and features of a similar nature:

| | | |
|---|---|---|
| McAllister | U.S. Pat. No. 5,462,513 | Dec. 31, 1995 |
| Classicon | U.K. 2,133,722 | Aug. 1, 1984 |
| Burnell | U.S. Pat. No. 4,981,219 | Jan. 1, 1991 |
| MacNicol | Australia 17487/34 | May 8, 1934 |
| | Australia 22055/35 | Apr. 2, 1935 |
| MacIssaac | U.S. Pat. No. 1,882,389 | Oct. 11, 1932 |
| Loison | U.S. Pat. No. 3,823,869 | Jul. 16, 1974 |
| Telle | D.T. 1,632,324 | Oct. 29, 1970 |

Knelson 284 discloses a machine of this general type which is intended to operate continuously in the sense that the feed slurry is supplied continuously to the centrifuge bowl while the discharge of heavier materials collected on the wall of the bowl is effected intermittently using a pinch valve at each discharge opening.

Knelson 523, 524, 965 and 572 disclose improvements in the above machine all of which have contributed to an improved functional machine.

Knelson 933 discloses a batch machine which operates intermittently and must be halted regularly for the collection of the heavier materials through a discharge opening at the base of the bowl. There is no continuous discharge of the heavier materials through discharge openings and the heavier materials is therefore collected in the bowl for intermittent or batch processing.

Knelson 040 discloses a particular arrangement of the fluidizing injection openings which are conventional in an arrangement of this type.

McAllister discloses a continuous discharge machine which also uses pinch valves at a series of discharge openings around a collection zone of the bowl.

MacNicol in the old two Australian patents discloses a particular bowl arrangement with injection openings at the base of a series of axially spaced riffles for collection of materials of the batch processing within the riffles.

Telle discloses a de-watering system for extracting water from particulate materials in which the particulate materials are collected on the wall of a centrifuge bowl and discharged outwardly through discharge ducts each of which has a pinch valve for controlling the discharge of the particulate materials. De-watering systems are of a different type from the particulate separation machines with which the present invention is concerned.

MacIssaac discloses a machine for separating particulate materials in which the heavier materials are collected on the wall of the bowl and intermittently discharged by opening valves located inside the bowl.

Classicon discloses a separation system for different particulate materials in which there are series of actually spaced discharged outlets each of which can be opened and closed by a valve arrangements.

Loison discloses a de-watering device for separating liquid from a solid in which the solids are collected outwardly of the bowl and are discharged by periodically opening a valve arrangement.

Burnell discloses an apparatus for separating different particles including a series of angularly spaced pockets each of which converges to a discharge duct through which the heavier materials are discharged on a continuous basis.

SUMMARY OF THE INVENTION

It is one object of the present invention to provide an improved method for separating particulate materials of different density in which the feed is substantially continuous and the heavier materials are discharged through discharge openings arranged on the peripheral wall.

According to the invention there is provided a method of separating a slurry containing intermixed particulate materials of different specific gravity comprising:

providing a centrifuge bowl having a peripheral wall and an open mouth;

rotating the bowl about a longitudinal axis so as to rotate the peripheral wall around the axis;

feeding the materials to the bowl so as to pass over the peripheral wall and causing the materials to separate such that a heavier portion of the materials collects on the peripheral wall while a lighter portion of the materials in the slurry escapes over the open mouth;

defining on the peripheral wall at least one axially localized annular recess for collecting the heavier portion of the materials;

defining in the recess an upper side wall and a lower side wall converging to a base interconnecting the side walls;

providing at the recess a plurality of angularly spaced discharge ports each for allowing materials collecting in the recess to discharge outwardly from the peripheral wall, each discharge port being located with a mouth at the base;

providing for each discharge port a valve operable for closing the port for preventing discharge of collecting materials and for opening the port, and periodically operating the valve during the separation of the materials to allow said discharge;

collecting the outwardly discharge materials;

injecting fluidizing liquid into the recess through a plurality of fluid injection ports arranged at angularly spaced positions around the recess for fluidizing the material in the recess;

providing in the recess a bed of movable bodies free to move within the recess and located inwardly of the fluid injection ports and inwardly of the discharge ports;

the movable bodies being larger than the particles and shaped to as to define interstices between the bodies so as to allow the particles to pass therebetween;

and confining the movable bodies within the recess.

Preferably the movable bodies are generally spherical so that they may be termed as balls. However a spherical shape is not essential and other shapes may be used and the term "beads" used herein is not intended to be limited to spherical shapes.

Preferably the movable bodies or beads are confined in the recess by a radially inner screen and a radially outer screen.

Preferably the inner screen and the outer screen are connected to form an insert member separate from the recess so as to be removable therefrom. However the screens or other constraining members may be formed as part of the structure of the recess. While screens are preferred since these can confine the beads regardless of the dimensions of the beads, other retaining members can be used which have larger openings to allow the passage of the materials while retaining the beads in the recess.

Preferably the inner screen and the outer screen are connected by two side walls of the insert member spaced by a width of the recess.

Preferably the side walls lie in radial planes of the axis of the bowl and preferably the recess has the side walls thereof each of which has a portion lying in a radial plane of the bowl at the side walls of the insert member. This is designed so that it follows the shape of the recess at this point so that the recess is closed by the screens and layer of beads. However the shape and arrangement of the insert member may be different from that of the recess provided that it remains in place during operation.

Preferably the recess has at least one side wall thereof which has a portion which is removable to allow ready release of the insert member for replacement when worn or when a different characteristic is required.

Preferably at least one of the side walls has an opening therein through which the bodies can be fed into the insert member for loading and for replacement of the beads by beads of a different size, density or material.

Preferably the bed of the movable bodies is arranged relative to the fluid injection so that at least some of the beads are moved radially inwardly of the bowl by inward fluid movement when the discharge ports are closed and at least some of the bodies are moved radially outwardly of the bowl by outward fluid movement when the discharge ports are opened.

Preferably the bed of movable bodies comprises sufficient of the bodies to provide a single layer of the bodies substantially in contact with one another within the recess. Although more layers of the beads can be provided to enhance the diffusion effect of the discharge at the separation surface.

The invention is also directed to the centrifuge apparatus for use in separating a slurry containing intermixed particulate materials of different specific gravity comprising:

a centrifuge bowl having a peripheral wall and an open mouth;

the bowl being mounted for rotation about a longitudinal axis so as to rotate the peripheral wall around the axis;

the bowl being arranged for feeding the materials to the bowl so as to pass over the peripheral wall and causing the materials to separate such that a heavier portion of the materials collects on the peripheral wall while a lighter portion of the materials in the slurry escapes over the open mouth;

at least one axially localized annular recess on the peripheral wall for collecting the heavier portion of the materials;

the recess having an upper side wall and a lower side wall converging to a base interconnecting the side walls;

a plurality of angularly spaced discharge ports at the recess each for allowing materials collecting in the recess to discharge outwardly from the peripheral wall, each discharge port being located with a mouth at the base;

each discharge port having a valve operable for closing the port for preventing discharge of collecting materials and for opening the port and arranged for periodically operating the valve during the separation of the materials to allow said discharge;

a plurality of fluid injection ports for injecting fluidizing liquid into the recess arranged at angularly spaced positions around the recess for fluidizing the material in the recess;

a bed of movable bodies in the recess free to move within the recess and located inwardly of the fluid injection ports and inwardly of the discharge ports;

the movable bodies being larger than the particles and shaped to as to define interstices between the bodies so as to allow the particles to pass therebetween;

and confining members mounted in the recess for confining the movable bodies within the recess.

The invention also includes as a separate aspect the insert member for use in a centrifuge apparatus as defined above where the insert member comprises:

a bed of movable bodies in the recess free to move within the recess and located inwardly of the fluid injection ports and inwardly of the discharge ports;

the movable bodies being larger than the particles and shaped to as to define interstices between the bodies so as to allow the particles to pass therebetween;

and confining members including a radially inner screen and a radially outer screen connected by two side walls of the insert member spaced by a width of the recess and arranged to be mounted in the recess for confining the movable bodies within the recess.

The modification disclosed herein is therefore an annular or circular diffusion ring that fits inside the recess. The diffusion ring is made of two screens mounted on a steel ring with space in between the screens. There are slots on the top steel ring to allow the "beads" to be loaded into the space between the two screens. The size of the screens and the distance between them is variable depending on the size of the machine. The size and specific properties of the beads are also variable. The beads may be glass spheres with a diameter of 5 mm. The beads can be made of various materials such as ceramics, steel, plastic, etc. The amount of beads added, in terms of the resulting bed thickness, is also a variable. For example, there may be just enough beads to provide a thickness of one bead diameter.

The purpose of this modification is to provide:

1. A "live reciprocating screen" for recovery of smaller high density particles.

2. An even distribution of fluidization water to the concentrating surface.

3. A "ragging bed" which oscillates inwardly and outwardly as the valves are closed and opened and thus assists in fluidizing and separating the particles within the recess rather than just at the mouth of the recess.

The machine is operated in such a manner that the fluidization water flow rate is set so that the beads are lifted away from the back screen and are essentially fluid or floating. The surface screen is essentially there so that these beads do not get blown out of the recess and into the tails stream. The pinch valves are opened at regular intervals in exactly the same manner as the operating procedure described in the above U.S. Pat. No. 6,149,572. The open and close times are variable and allows for a variable amount of mass to be pulled to the concentrate.

When the pinch valves are closed, the fluidization water lifts the bead bed away from the back screen. When the pinch valves open, the bead bed collapses but also pulls the concentrated bed formed on the surface of the screen to be collapse through the interstitial spaces between the beads. A jigging effect also takes place as high density particles (in the ore) would tend to collapse faster than the lower density beads. This is where the concept of using beads of different materials (i.e. different specific gravities) may be useful. It may allow the differential recovery of different mineral species in the ore.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
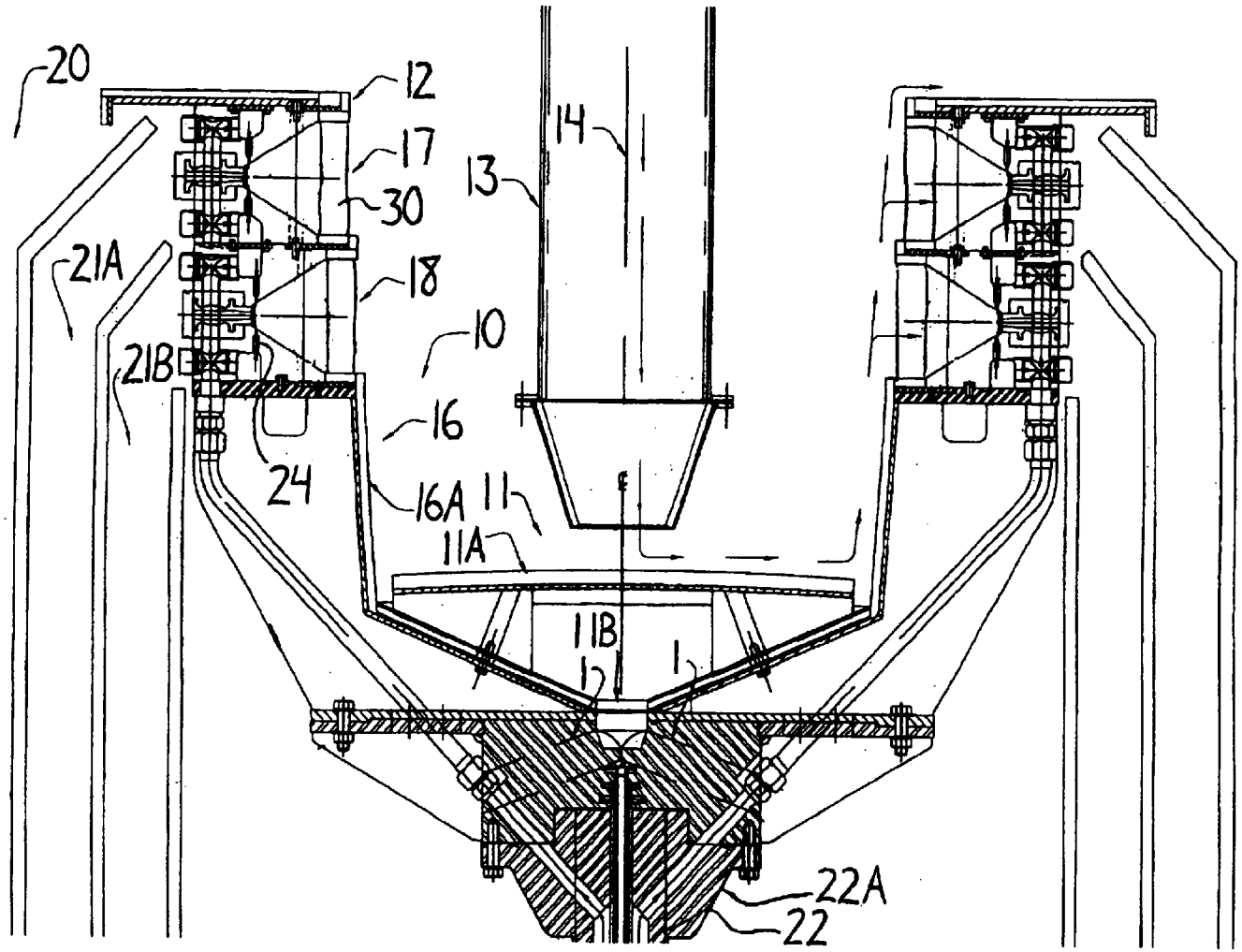
FIG. 1 PRIOR ART
FIG. 1 is a vertical cross sectional view through a bowl of a continuous variable discharge separation system, which is taken from U.S. Pat. No. 6,149,572 above to show the basic construction of the apparatus with which the present invention is concerned.

The centrifugal separation apparatus as shown in FIG. 1, and described in more detail in the above US patent to which reference should be made if further detail is required, comprises a bowl generally indicated at 10 having a base 11 and an open mouth 12. A feed duct 13 comprises a vertical pipe mounted on a central axis 14 of the bowl for feeding a slurry 15 downwardly onto the base 11 of the bowl. The bowl 10 includes a peripheral wall 16 so that the slurry moving outwardly to the peripheral wall under centrifugal forces passes over the peripheral wall for collection of heavier materials in a pair of collection recesses 17 and 18 and for discharge of lighter materials and water over the open mouth 12.

The material collecting in the recesses 17 and 18 is discharged radially outwardly through a series of discharge ports at spaced positions around the recess. Each discharge port forms part of a discharge port and valve assembly 19.

The materials discharged from the open mouth is collected within a first launder 20 for collection and transportation to a discharge area. The heavier materials collected within the recess 17 is discharged from the assembly 19 and collected within a middle launder 21A. Similarly the material discharged from the recess 18 is collected within a third launder 21B.

The bowl 10 is mounted on a shaft 22 for rotation about the axis 14.

U.S. Pat. No. 5,222,933 discloses further details of the base of the bowl including a base plate 11A and a bottom discharge opening 11B.

Reference is made to Knelson U.S. Pat. Nos. 5,601,523, 5,601,524 and WO97/02894 (mentioned above) all of which disclose various constructional features of the above machine. In particular construction of the shaft is shown in U.S. Pat. No. 5,601,524. Further the general shape of the bowl including a lower frusto-conical portion 16A which directs the feed material across the recesses 17 and 18 is shown in U.S. Pat. No. 5,586,965. The further patents can be referred to for further details of the construction if required.

Each recess has a plurality of fluid injection openings 24 for injecting fluidizing water into the recess adjacent the base of the recess so the fluidizing water can flow through the recess and mix with the materials in the recess as described in the prior patents of Knelson.

A hub 22A carries the bowl and is mounted on a shaft 22 is of the type generally shown in U.S. Pat. No. 5,601,524 for supply of fluidizing water through the hollow shaft to the supply ducts.

In general the shaft 22 is connected to a water supply coupling at the lower end (not shown) so that water is supplied through a hollow interior of the shaft for connection to ducts which extend outwardly to the couplings for supplying the injection openings 24.

The general shape of the bowl including the two recesses 17 and 18 together with the first conical section 16 is substantially as described in U.S. Pat. No. 5,586,965. However the bowl as shown herein is modified relative to the bowl of the above patent in that it includes a bottom discharge opening 11B connecting to ducts 1 and a base plate 11A above the bottom discharge opening.

In normal operation of the bowl as shown herein, the feed material is separated so that the heavier particles collect within the recesses and the lighter particles and water escape over the mouth 12. The heavier particles are then discharged by periodic opening of the pinch valves to allow release of a plug of collected heavier particles. The tapered shape of the inside surface ensures that the plug can freely escape into the valve section and through the valve section to the exterior launder for collection.

Figure 2:
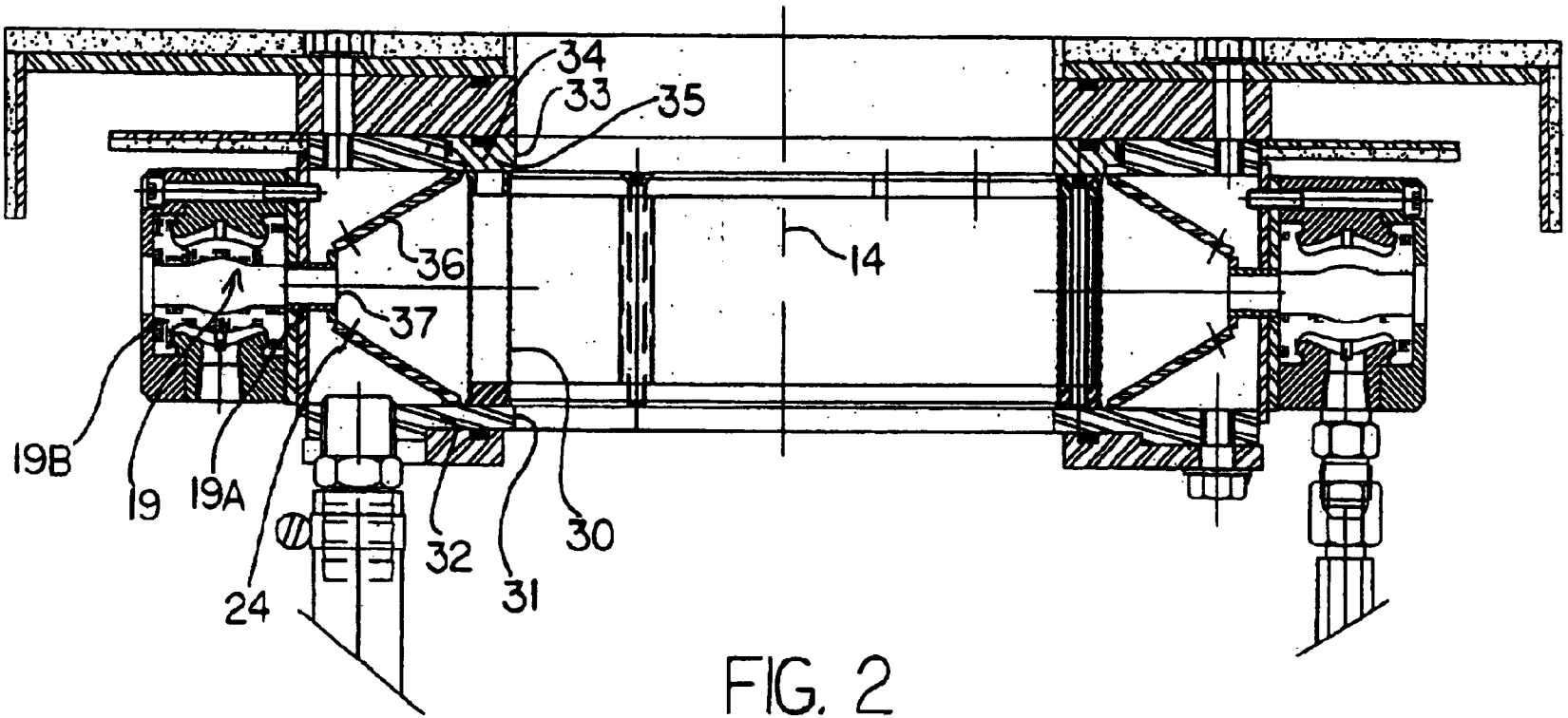
FIG. 2 is a vertical cross sectional view similar to that of FIG. 1 through the same bowl with the insert member of the present invention added.
Figure 4:
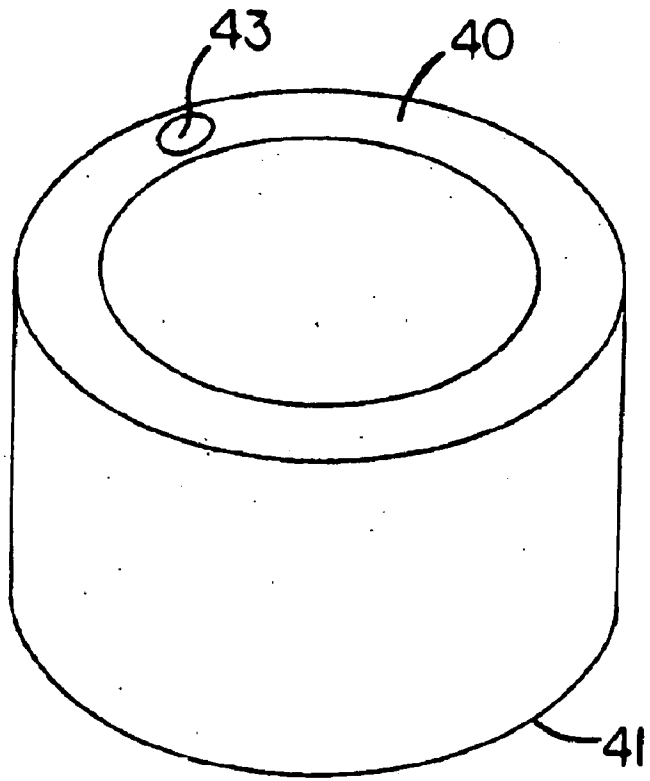
FIG. 4 is an isometric view of the insert member alone.
Figure 3:
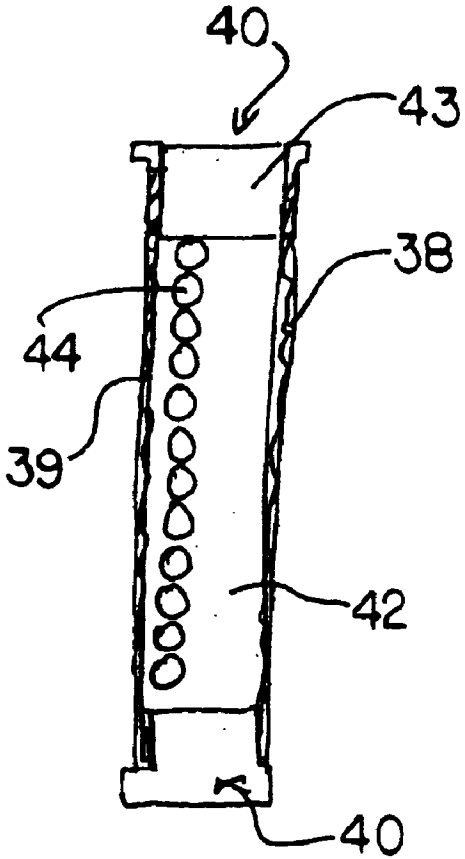
FIG. 3 is a vertical cross sectional view similar to that of FIG. 2 on an enlarged scale showing only one side insert member.

As best shown in FIG. 2, the recesses are modified to include an additional insert member 30 which is mounted in the recess at the mouth of the recess. The recess is thus defined by an inner edge 31 on the bottom side wall 32 and an inner edge 33 on the top side wall 34. Each of the side walls includes a first portion lying in a radial plane of the axis 14. The upper side wall 34 includes the radial portion 35 which can be removed to allow insertion of the annular member 30 at that position. Each of the side walls from its radial portion includes an inwardly converging portion 36 which extends to a base 37 at which is located the port 19A of the discharge valve assembly 19 which includes the valve 19B.

At the base or at the bottom of the side wall is provided the injection openings 24 for injection of fluidizing water into the recess.

The annular insert member 30 comprises an inner screen 38 and an outer screen 39 both of which are formed into a cylindrical shape with the outer screen 39 having a larger diameter. The inner and outer screens are connected by top and bottom side walls 40 and 41 respectively which connect the screens and provide a hollow interior 42 between the screens and between the sidewalls. The top sidewall 40 includes an opening 43 by which beads 44 can be inserted into the hollow interior 42. Thus the insert member provides a confining cavity for receiving a plurality of beads forming a bed within the insert member and confined by the insert member. The beads are thus held within the recess by the inner and outer screens at a position radially inward of the injection and discharge ports and radially outward of the mouth of the recess defined by the cylindrical surface containing the inside edges 31 and 33. The inside screen 38 is located substantially at the inside surface of the recess or mouth of the recess so that separation of the materials from the material flowing over the mouth of the recesses occurs at or just inside the screen 38.

The balls or beads are located within the hollow interior of the insert member and are held in position within the recess so that the beads can move freely within the hollow interior 42 under the fluid forces generated by the discharge through the discharge port and the injection through the inlet port.

As the beads have a larger diameter than the particles they are more affected by fluid flow so that they move inwardly and outwardly under fluid flow regardless of the relative densities. The beads do not fill the cavity 42 so that the beads are free to move between the inner and outer screens. The beads are shown in a single layer but there may be provided additional beads to provide a greater number of layers. The beads will of course tend to move and float within the cavity. However the beads will tend to migrate between the inner and outer screens. When there is a net tendency of the beads to migrate radially outwardly, they will spread over the outer screen to form a bed. Similarly when there is a net flow inwardly from the injection water fluidizing the recess, with the valve closed, the beads will tend to float onto the inner screen 38 again forming a bed thereon.

The effect of the beads is that it tends to spread the flow from the recess into the discharge port when the valve is opened, over a larger area at the mouth of the recess. Thus instead of a shallow or narrow cone being formed-of material collapsing into the discharge port, the cone may extend outwardly to the bed of beads but then is diffused by the beads. Thus radially inwardly of the beads, the bed within the recess tends to collapse toward the discharge port through the bed as a smoothly moving zone of collapse over the full area of the bed inwardly of the beads. Thus, where the concentration is occurring primarily at the mouth of the recess, the hole of the material collecting at the mouth of the recess moves radially outwardly toward the discharge port.

Furthermore the balls tend to move through the material within the container 42 so as to fluidize the materials within that area and thus assist in separating heavier from lighter particles within that zone. Thus the heavier particles tend to move past or between the beads more quickly to the screen 39 for discharge through the discharge port while lighter particles tend to remain adjacent the screen 38 and thus can be moved outwardly when the outward flow recommences as the valve is closed.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of separating a slurry containing intermixed particulate materials of different specific gravity comprising:

providing a centrifuge bowl having a peripheral wall and an open mouth;

rotating the bowl about a longitudinal axis so as to rotate the peripheral wall around the axis;

feeding the materials to the bowl so as to pass over the peripheral wall and causing the materials to separate such that a heavier portion of the materials collects on the peripheral wall while a lighter portion of the materials in the slurry escapes over the open mouth;

defining on the peripheral wall at least one axially localized annular recess for collecting the heavier portion of the materials;

defining in the recess an upper side wall and a lower side wall converging to a base interconnecting the side walls;

providing at the recess a plurality of angularly spaced discharge ports each for allowing materials collecting in the recess to discharge outwardly from the peripheral wall, each discharge port being located with a mouth at the base;

providing for each discharge port a valve operable for closing the port for preventing discharge of collecting materials and for opening the port, and periodically operating the valve during the separation of the materials to allow said discharge;

collecting the outwardly discharge materials;

injecting fluidizing liquid into the recess through a plurality of fluid injection ports arranged at angularly spaced positions around the recess for fluidizing the material in the recess;

providing in the recess a bed of movable bodies free to move within the recess and located inwardly of the fluid injection ports and inwardly of the discharge ports; the movable bodies being larger than the particles and shaped to as to define interstices between the bodies so as to allow the particles to pass therebetween;

and confining the movable bodies within the recess.

2. The method according to claim 1 wherein the movable bodies are generally spherical.

3. The method according to claim 1 wherein the movable bodies are confined in the recess by a radially inner screen and a radially outer screen.

4. The method according to claim 3 wherein the inner screen and the outer screen are connected to form an insert member separate from the recess so as to be removable therefrom.

5. The method according to claim 4 wherein the inner screen and the outer screen are connected by two side walls of the insert member spaced by a width of the recess.

6. The method according to claim 5 wherein the side walls lie in radial planes of the axis of the bowl.

7. The method according to claim 5 wherein the recess has the side walls thereof each of which has a portion lying in a radial plane of the bowl at the side walls of the insert member.

8. The method according to claim 5 wherein the recess has at least one side wall thereof which has a portion which is removable to allow release of the insert member.

9. The method according to claim 5 wherein at least one of the side walls has an opening therein through which the bodies can be fed into the insert member.

10. The method according to claim 1 wherein the bed of the movable bodies is arranged relative to the fluid injection so that at least some of the bodies are moved radially inwardly of the bowl by inward fluid movement when the discharge ports are closed and at least some of the bodies are moved radially outwardly of the bowl by outward fluid movement when the discharge ports are opened.

11. The method according to claim 1 wherein the bed of movable bodies comprises sufficient of the bodies to provide a single layer of the bodies substantially in contact with one another within the recess.

12. A centrifuge apparatus for use in separating a slurry containing intermixed particulate materials of different specific gravity comprising:

a centrifuge bowl having a peripheral wall and an open mouth;

the bowl being mounted for rotation about a longitudinal axis so as to rotate the peripheral wall around the axis;

the bowl being arranged for feeding the materials to the bowl so as to pass aver the peripheral wall and causing the materials to separate such that a heavier portion of the materials collects on the peripheral wall while a lighter portion of the materials in the slurry escapes over the open mouth;

at least one axially localized annular recess on the peripheral wall for collecting the heavier portion of the materials;

the recess having an upper side wall and a lower side wall converging to a base interconnecting the side walls;

a plurality of angularly spaced discharge ports at the recess each for allowing materials collecting in the recess to discharge outwardly from the peripheral wall, each discharge port being located with a mouth at the base;

each discharge port having a valve operable for closing the port for preventing discharge of collecting materials and for opening the port and arranged for periodically operating the valve during the separation of the materials to allow said discharge;

a plurality of fluid injection ports for injecting fluidizing liquid into the recess arranged at angularly spaced positions around the recess for fluidizing the material in the recess;

a bed of movable bodies in the recess free to move within the recess and located inwardly of the fluid injection ports and inwardly of the discharge ports;

the movable bodies being larger than the particles and shaped to as to define interstices between the bodies so as to allow the particles to pass therebetween;

and confining members mounted in the recess for confining the movable bodies within the recess.

13. The apparatus according to claim 12 wherein the movable bodies are generally spherical.

14. The apparatus according to claim 12 wherein the movable bodies are confined in the recess by a radially inner screen end a radially outer screen.

15. The apparatus according to claim 14 wherein the inner screen and the outer screen are connected to form an insert member separate from the recess so as to be removable therefrom.

16. The apparatus according to claim 15 wherein the inner screen and the outer screen are connected by two side walls of the insert member spaced by a width of the recess.

17. The apparatus according to claim 16 wherein the side walls lie in radial planes of the axis of the bowl.

18. The apparatus according to claim 16 wherein the recess has the side walls thereof each of which has a portion lying in a radial plane of the bowl at the side walls of the insert member.

19. The apparatus according to claim 16 wherein the recess has at least one side wall thereof which has a portion which is removable to allow release of the insert member.

20. The apparatus according to claim 16 wherein at least one of the side walls has an opening therein through which the bodies can be fed into the insert member.

21. The apparatus according to claim 12 wherein the bed of the movable bodies isarranged relative to the fluid injection so that at least some of the bodies are moved radially inwardly of the bowl by inward fluid movement when the discharge ports are closed and at least some of the bodies are moved radially outwardly of the bowl by outward fluid movement when the discharge ports are opened.

22. The apparatus according to claim 12 wherein the bed of movable bodies comprises sufficient of the bodies to provide a single layer of the bodies substantially in contact with one another within the recess.

23. An insert member for use in a centrifuge apparatus for separating a slurry containing intermixed particulate materials of different specific gravity, the centrifuge apparatus including:

a centrifuge bowl having a peripheral wall and an open mouth;

the bowl being mounted for rotation about a longitudinal axis so as to rotate the peripheral wall around the axis;

the bowl being arranged for feeding the materials to the bowl so as to pass over the peripheral wall and causing the materials to separate such that a heavier portion of the materials collects on the peripheral wall while a lighter portion of the materials in the slurry escapes over the open mouth;

at least one axially localized annular recess on the peripheral wall for collecting the heavier portion of the materials;

the recess having an upper side wall and a lower side wall converging to a base interconnecting the side walls;

a plurality of angularly spaced discharge ports at the recess each for allowing materials collecting in the recess to discharge outwardly from the peripheral wall, each discharge port being located with a mouth at the base;

each discharge port having a valve operable for closing the port for preventing discharge of collecting materials and for opening the port and arranged for periodically operating the valve during the separation of the materials to allow said discharge;

and a plurality of fluid injection ports for injecting fluidizing liquid into the recess arranged at angularly spaced positions around the recess for fluidizing the material in the recess;

the insert member comprising:

a bed of movable bodies in the recess free to move within the recess and located inwardly of the fluid injection ports and inwardly of the discharge ports;

the movable bodies being larger than the particles and shaped to as to define interstices between the bodies so as to allow the particles to pass therebetween;

and confining members including a radially inner screen and a radially outer screen connected by two side walls of the insert member spaced by a width of the recess and arranged to be mounted in the recess for confining the movable bodies within the recess.

24. The insert member according to claim 23 wherein the movable bodies are generally spherical.

25. The insert member according to claim 23 wherein the side walls lie in radial planes of the axis of the bowl.

26. The insert member according to claim 23 wherein at least one of the side wells has an opening therein through which the bodies can be fed into the insert member.

27. The insert member according to claim 23 wherein the bed of movable bodies comprises sufficient of the bodies to provide a single layer of the bodies substantially in contact with one another within the recess.

* * * * *